US012082674B2

(12) United States Patent
Moore

(10) Patent No.: US 12,082,674 B2
(45) Date of Patent: Sep. 10, 2024

(54) ANCHOR POINT DEVICE FOR HYGIENIC EPILATION BY THREADING

(71) Applicant: Gloria M. Moore, Edmond, OK (US)

(72) Inventor: Gloria M. Moore, Edmond, OK (US)

( * ) Notice: Subject to any disclaimer, the term of this patent is extended or adjusted under 35 U.S.C. 154(b) by 200 days.

(21) Appl. No.: 16/887,327

(22) Filed: May 29, 2020

(65) Prior Publication Data

US 2021/0368958 A1 Dec. 2, 2021

(51) Int. Cl.
*A45D 26/00* (2006.01)

(52) U.S. Cl.
CPC .... *A45D 26/0042* (2013.01); *A45D 2026/008* (2013.01)

(58) Field of Classification Search
CPC ..... A45D 26/0042; A45D 2026/008; A45D 8/34; A45F 2005/006; A45F 2005/023; A45F 2/02; F16G 11/10; F16G 11/108; A61B 17/0487; Y10T 24/39; Y10T 24/3984
See application file for complete search history.

(56) References Cited

U.S. PATENT DOCUMENTS

| | | | | |
|---|---|---|---|---|
| 1,243,162 | A | 10/1917 | Gruman | |
| 1,282,953 | A | 10/1918 | Sauer | |
| 4,106,874 | A | 8/1978 | Torii | |
| 4,265,561 | A * | 5/1981 | Heckele | A61B 1/00147 403/3 |
| 4,386,865 | A | 6/1983 | Kageyama et al. | |
| 5,247,706 | A * | 9/1993 | Mark | A61F 9/025 2/427 |
| 5,606,782 | A * | 3/1997 | Patterson | F16G 11/101 24/598.5 |
| 7,350,996 | B2 | 4/2008 | Bielecki et al. | |
| 8,192,446 | B2 | 6/2012 | Mueller | |
| 8,506,579 | B1 | 8/2013 | Bareli et al. | |
| 8,608,757 | B2 | 12/2013 | Iwegbu | |
| 9,004,792 | B2 | 4/2015 | Wisler et al. | |
| 9,856,586 | B2 | 1/2018 | Shomura et al. | |
| 9,949,517 | B2 | 4/2018 | Howard | |
| 10,507,685 | B2 | 12/2019 | Tsukioka et al. | |
| 10,603,948 | B2 | 3/2020 | Odaka et al. | |
| 2009/0177031 | A1* | 7/2009 | Surti | A61B 1/00087 606/139 |
| 2009/0320247 | A1* | 12/2009 | Honeycutt | A41D 1/002 24/129 R |
| 2012/0089156 | A1 | 4/2012 | Zangrande et al. | |
| 2015/0314632 | A1 | 11/2015 | Koizumi et al. | |
| 2016/0270459 | A1 | 11/2016 | Mueller, III | |

OTHER PUBLICATIONS

KEVIN 123; "What is the difference between a clutch pencil and a mechanical pencil?"; retrieved on May 11, 2020 from https://www.bebee.com.

* cited by examiner

*Primary Examiner* — Todd J Scherbel
(74) *Attorney, Agent, or Firm* — Robert H. Frantz

(57) ABSTRACT

A device for holding and tensioning a segment of thread for epilation having a thread-holding chuck configured to receive, lock, and selectively release a segment of epilation thread; and an attachment to secure the thread-holding chuck to a user-worn element of gear, such as but not limited to a neck strap, a head band, a face shield, a vest, a button, a button hole, a safety pin, a hat, or a shirt.

12 Claims, 7 Drawing Sheets

800

ANCHOR POINT DEVICE FOR HYGIENIC EPILATION BY THREADING

FIELD OF THE INVENTION

The present invention relates to certain improvements of tools and devices used for epilation, especially for eyebrow threading.

BACKGROUND OF INVENTION

Epilation of hair from the skin, especially facial hair, such as eyebrows, is a popular method of modifying one's appearance. Among the various methods are chemical removal of hair, removal of hair using wax-like compounds, tweezing, shaving, electrolysis, laser follicle destruction, and "threading".

According to Wikipedia, threading is a method of hair removal which is believed to have originated in in Iran, India, and/or Central Asia, and it has gained popularity in western countries, especially for shaping eyebrows. During threading, a specially trained cosmetological technician uses a thin cotton or polyester thread, which is doubled and then twisted. The intersection of the twisted thread is rolled over skin having hair to be remove, which results in a plucking action with great precision under the control of the technician. Entire rows of hair can be removed simultaneously, enabling the technician to establish very well-defined edges, lines and shapes. Threading can be used on any part of the face or body, and often is used on upper lips, as well.

Most techniques of threading include using at least both hands of the technician to form a loop of thread which is then twisted multiple times into an X-pattern stretched between the hands. One particular method includes a third point of anchoring the thread in the technician's mouth, giving the technician even greater control over the tension in the thread pattern, which can be modulated to adjust for different client's skin type, sensitivity to pain, and speed.

SUMMARY OF THE EXEMPLARY EMBODIMENTS OF THE INVENTION

A device is disclosed for holding and tensioning a segment of thread for epilation having a thread-holding chuck configured to receive, lock, and selectively release a segment of epilation thread; and an attachment to secure the thread-holding chuck to a user-worn element of gear, such as but not limited to a neck strap, a head band, a face shield, a vest, a button, a button hole, a safety pin, a hat, or a shirt.

BRIEF DESCRIPTION OF THE DRAWINGS

The figures presented herein, when considered in light of this description, form a complete disclosure of one or more embodiments of the invention, wherein like reference numbers in the figures represent similar or same elements or steps.

DETAILED DESCRIPTION OF ONE OR MORE EXEMPLARY EMBODIMENT(S) OF THE INVENTION

Figure 8:
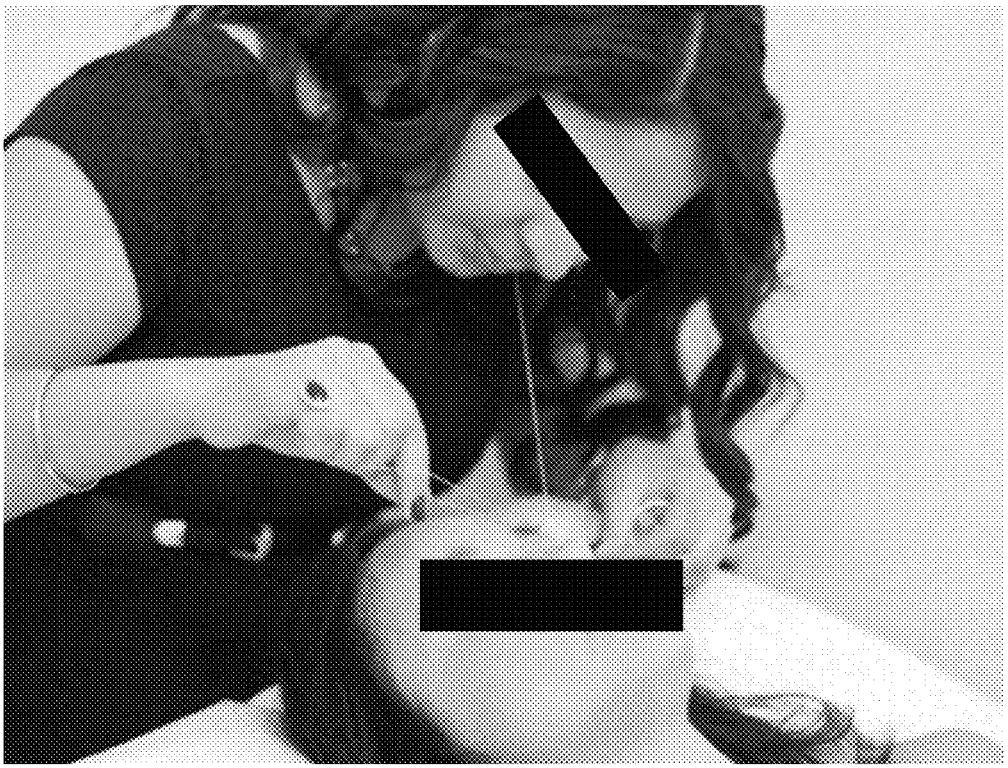
FIG. 8 illustrates a well-known method of epilation by threading in which a technician's mouth is used as a third anchor point for the thread.

The present inventor has recognized that, especially during heightened hygiene awareness during a disease season or pandemic, present day threading tools and devices are insufficient to meet rapidly evolving regulations and practices during epilation by threading. When a threading technician uses both hands, which may be gloved, and a third anchor point of their mouth, as shown 800 in FIG. 8 in order to obtain improved precision and pressure control, there is presently no way to protect the client from potential contamination from the technician's saliva wicking down the thread and onto the client's skin. Further, some skin cells from the technician may transfer to the thread, and then to the client.

To meet this unsatisfied need in the art, the present inventor has invented an anchoring device to provide the third point of control in lieu of the user's mouth. This anchoring device retains much of the tactile feedback that the technician can obtain from holding and tensioning the thread in their mouth, but without the possibility of contamination.

Figure 1:
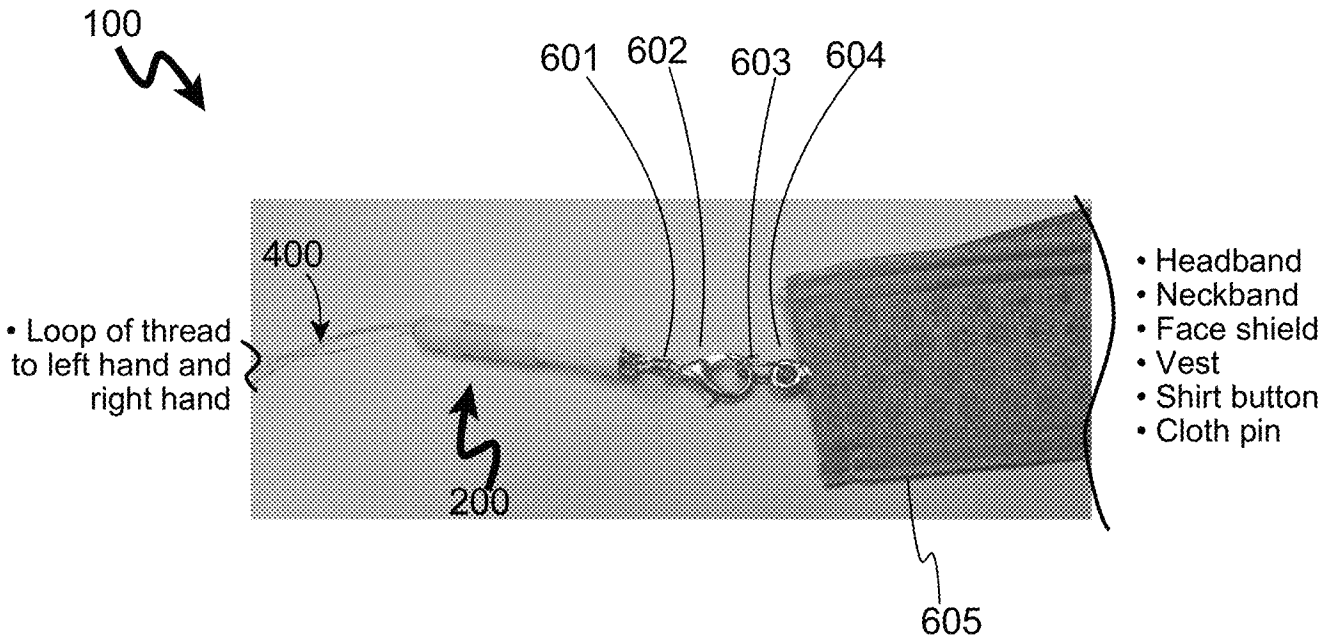
FIG. 1 illustrates an example embodiment according to the present invention of a neckband-based system.

FIG. 1 illustrates a portion of a system 100 to provide this anchor point, which includes a variety of means to attach the system to the user (threading technician), including but not limited to a headband, neckband, face shield, vest, shirt button, or pin to clothing. This particular example embodiment shows a portion 605 of a 1-inch wide ribbon loop which can be affixed loosely around the user's neck. The thread 400 is received into a holding chuck 200, which is then attached to the user attachment means 605 through one or more mechanical interconnects 601-604, such as components of readily available jewelry supplies, as will be explained further in the following paragraphs. In such a configuration, the system 100 is comfortable and safe for the user to wear, provides tactile feedback to the user regarding tension and resistance on the thread, and allows the user an intuitive third anchoring point, in addition to their hands, for controlling the threading process.

Figure 3:
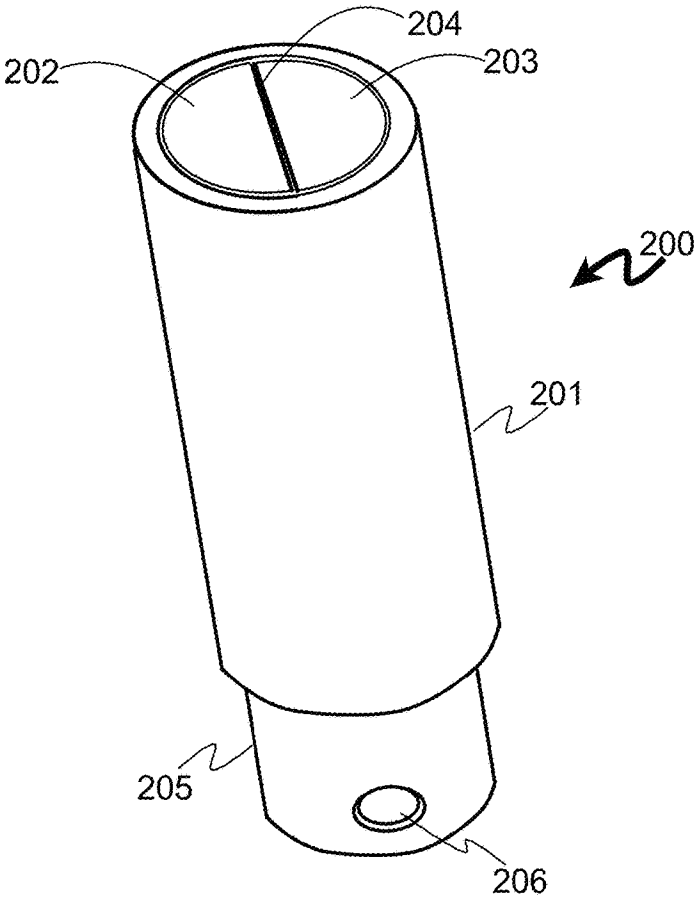
FIG. 3 illustrates an example embodiment according to the present invention of a chuck with the jaws closed.
Figure 2:
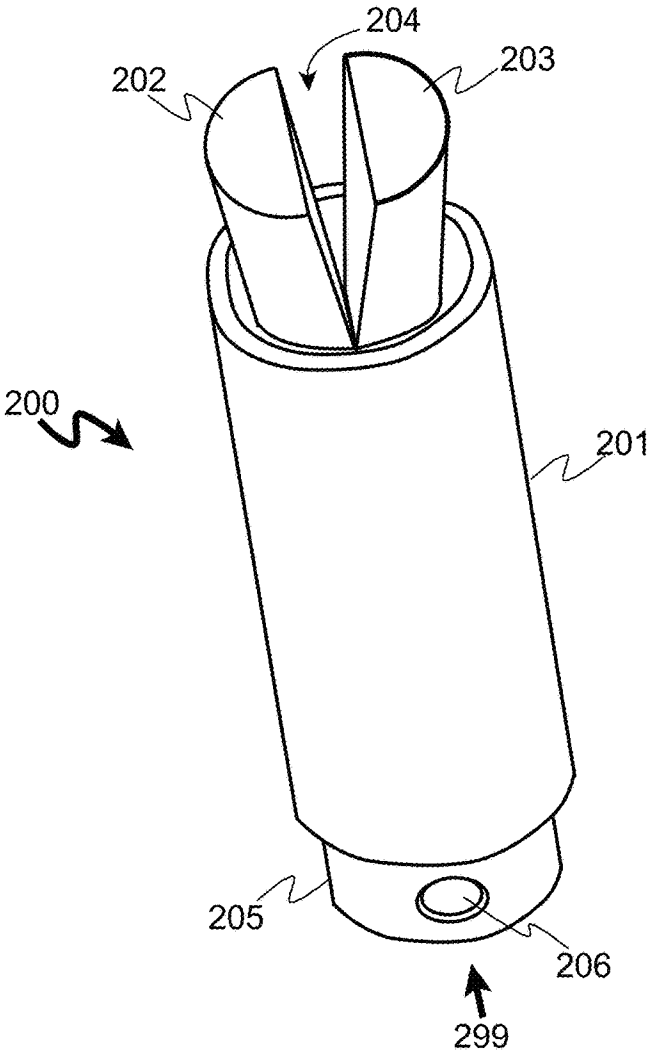
FIG. 2 illustrates an example embodiment according to the present invention of a chuck with the jaws open.

FIGS. 2 and 3 illustrate an example embodiment of a thread holding chuck 200 according to the present invention. In FIG. 2, the chuck is shown in an open configuration during which two or more jaws 202, 203 are opened temporarily to produce a gap 204 into which anything that is received may be clamped securely. In this embodiment, a cylindrical body 201 is provided with a spring-loaded core 205 which normally urges the clamps 202, 203 into the cylinder where they are pressed together to close the gap 204, as shown in FIG. 3. Thus, when pressure 299 is applied on the core 205, the spring force is overcome, and the jaws are driven outward from the body 201. The jaws in this example embodiment are formed of a plastic material which is molded or machined to curve or flare away from each other, such that when they are no longer confined within the body 201, they flex away from each other to produce the open gap 204. Further, according to this example embodiment, a hole 206 is provided in the core 205 to allow attachment to the user.

Figure 4:
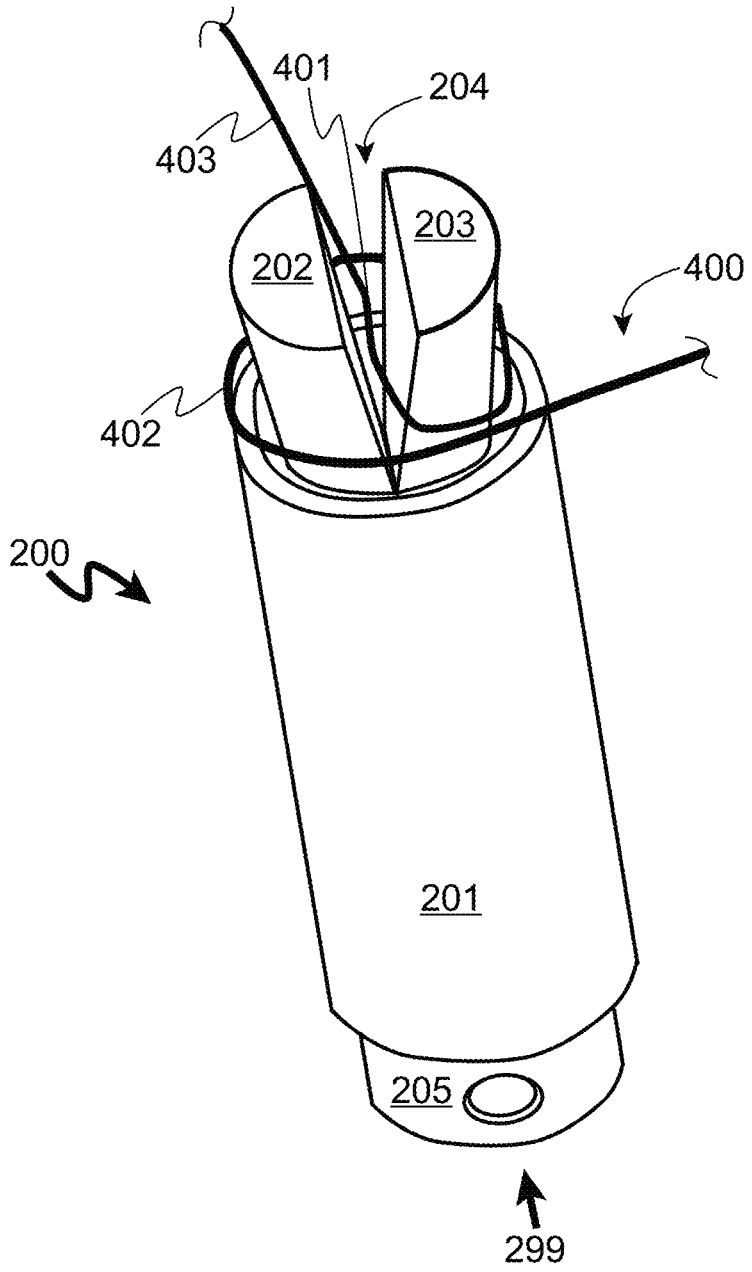
FIG. 4 depicts a method of inserting a loop of thread into an open chuck as depicted in FIG. 2.
Figure 5:
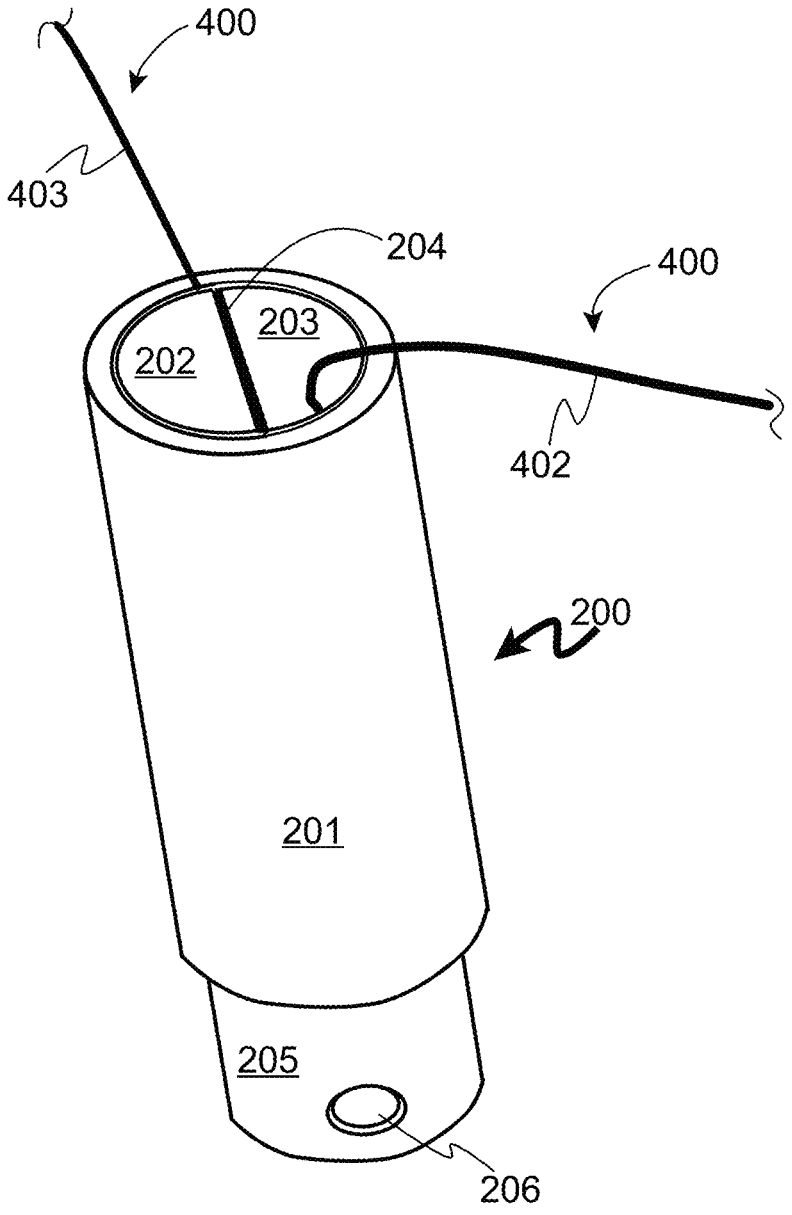
FIG. 5 depicts a locked loop of thread in a closed chuck as depicted in FIG. 3.

FIGS. 4 and 5 illustrate at least one method according to the present invention for how the chuck is used secure and anchor a loop of thread 400 for use during threading epilation. The user applies force, such as by pressing with a finger or holding and pushing the body towards a table surface onto the core, to cause the jaws to extend and open up, as shown in FIG. 4. A segment of thread 401 is placed straight through the gap 204, dividing the thread into two portions 402, 403 extending both ends of the gap 204. Then, one of the thread portions, such as portion 402, is wrapped 402 around the outside of the entire jaws at least one time. While the thread 400 is maintained in this configuration, pressure on the core 205 is released slowly so that the jaws 202, 203 are drawn closed and into the body 201, thereby capturing the thread 400 in the gap 204 between the jaws 202, 203, and capturing the wrapped portion of thread between the outside of the jaws and the inside surface of the body, such that the two portions 402, 403 of thread exit the chuck from essentially opposite points, as shown in FIG. 5.

The present inventor has prototyped such a chuck by removing a core from a conventional plastic mechanical pencil manufactured by Paper Mate™ (Sanford L.P.) under the model name Mirado™. However, it is believed that many other mechanical pencils could be used in the following manner, or that a custom designed thread chuck could be produced specifically for this purpose. After removing the core mechanism from the mechanical pencil, the lead rod tube is cut away from the ratcheting lead chuck of the core mechanism, with a short portion of the lead rod tube being retained on the ratcheting lead chuck. Then, a hole 206 is formed in the short portion of the tube, or another attachment means with a hole is glued to the short portion of remaining lead rod tube. The remaining, cut-free portion of lead rod tube is discarded.

Figure 6:
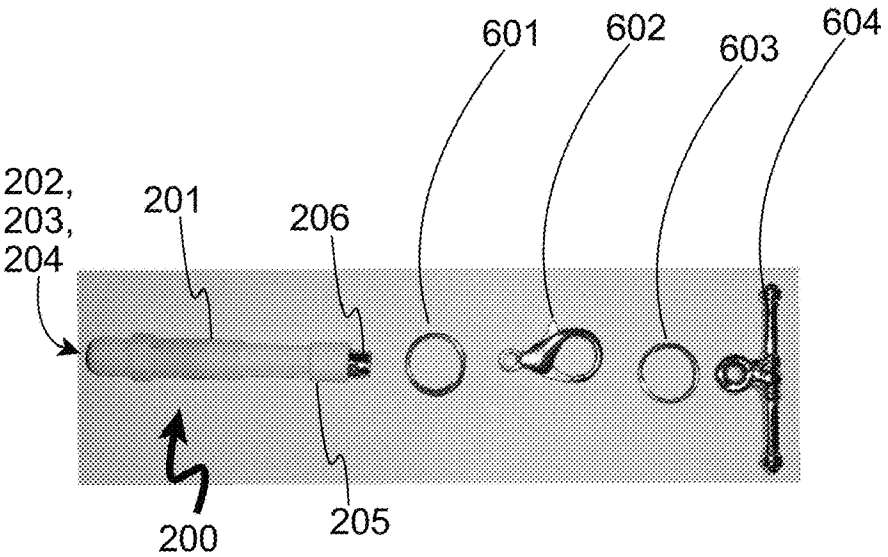
FIG. 6 provides an exploded view of hardware components to connect an example chuck to a means for attaching the system to a user.

FIG. 6 shows an exploded view of the attachment components of this particular example embodiment, while other combinations of one or more components are possible within the spirit and scope of the present invention. The thread lock chuck 200, which in this example is the repurposed lead rod chuck from the aforementioned mechanical pencil, is combined in series with a first split ring 601, a spring ring clasp 602, a second split ring 603, and a T-shaped toggle of a toggle clasp, into the assembly shown in FIG. 7.

Figure 7:
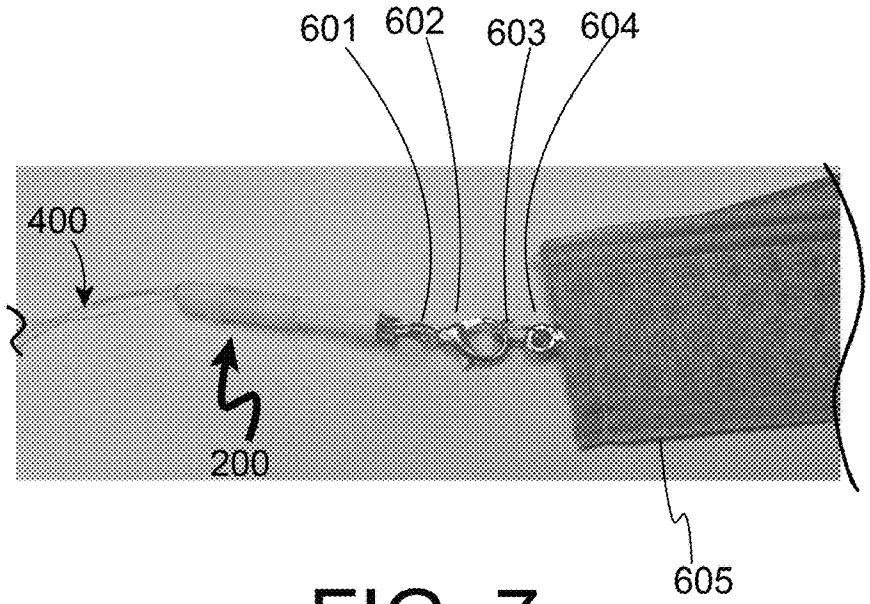
FIG. 7 illustrates the hardware components of FIG. 6 in an assembled configuration.

Also in FIG. 7, this particular example embodiment is shown with the toggle 604 sewn into a pocket formed in a loop of 1-inch wide ribbon, the rest of which serves as an adjustable neck band for wear by the user. And, a loop of thread 400 is depicted as captured in the thread lock chuck 200, suitable for use as a third point of anchor during threading epilation.

Figure 9:
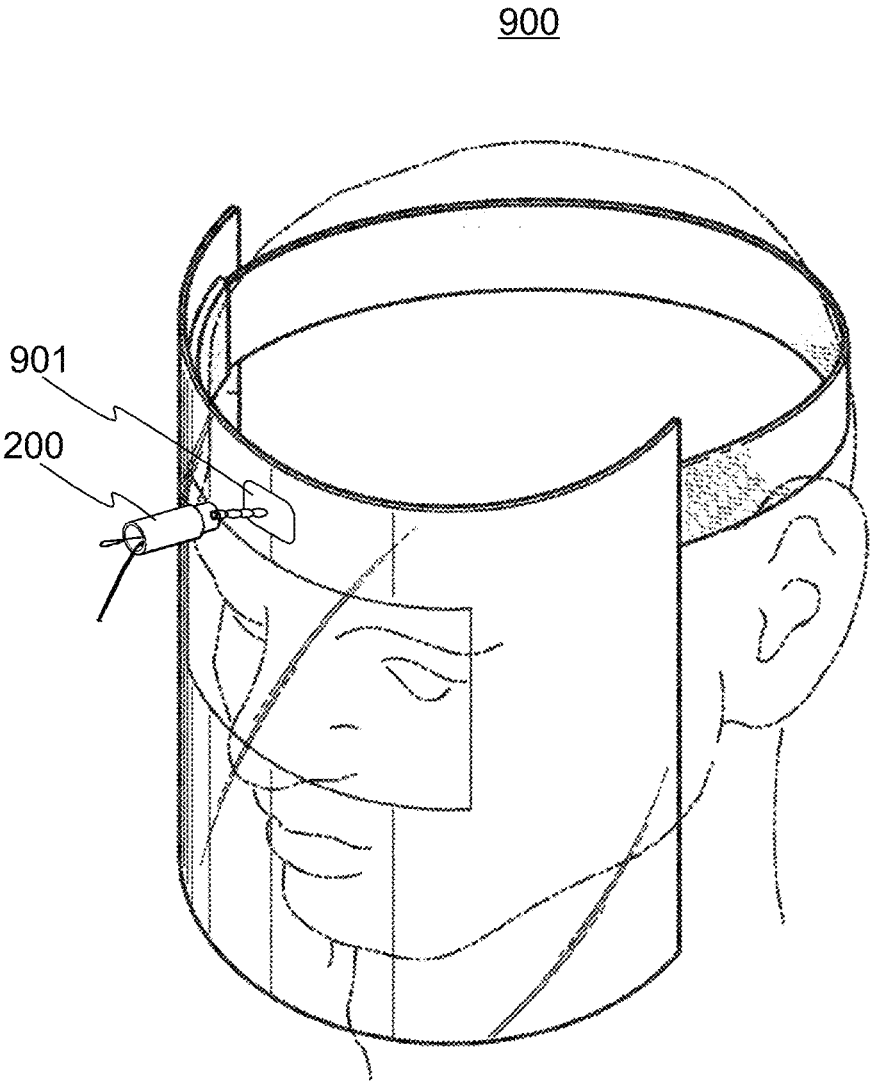
FIG. 9 illustrates another embodiment according to the present invention in which the system is attached to a clear face shield.

In other embodiments of the present invention, the attachment hardware components 601-604 may be adapted as appropriate to attach the thread locking chuck to alternative points on the user's clothing or protective gear. For example, instead of attaching to a neckband, it can be attached to a headband, or to a clear plastic face shield 901, such as the face shield taught in U.S. Pat. No. 9,949,517 B2 to Edward Ray Howard, as shown in FIG. 9, using a hole drilled into the face shield or an anchoring loop adhered to the surface of the face shield, such as by using an adhesive-backed cable tie base from 3M™ or similar. Or, a user can attach the spring ring clasp to a safety pin which is pinned to a shirt or vest, or the toggle can be pushed through a button hole on a shirt or vest to provide a user attachment.

CONCLUSION

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof, unless specifically stated otherwise.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A system for holding and tensioning a segment of epilation thread for performing epilation by a user, comprising:

a hollow body having one or more interior walls of the hollow body;

a thread holder having two or more opposing chuck jaws configured to open upon extending from the hollow body upon user actuation, and to close together upon retracting into the hollow body absent user actuation;

the segment of epilation thread divided into first and second portions, the first portion being received across and between the two or more opposing chuck jaws, and the second portion being wrapped around an outside of all of the two or more opposing chuck jaws, such that the segment of epilation thread is captured and locked by the body and the retracted two or more opposing chuck jaws with a remainder of the epilation thread exiting the body from opposite points across the thread holder;

an attachment configured to secure the body to a user-worn element of gear.

2. The apparatus of claim 1 wherein the two or more jaws comprise opposing and mating jaw surfaces which are smooth, and wherein the smooth jaw surfaces are configured to close tightly upon each other when the jaws are retracted into the body to capture small diameter epilation thread.

3. The apparatus of claim 2 wherein the thread holding further comprises:

an outer cylinder portion of the body;

a core rod received into a first end of the outer cylinder portion; and a spring disposed between the core rod and the two or more jaws;

wherein the spring urges the jaws into a second end of the outer cylinder portion forcing the jaws into a closed configuration, and wherein pressure on the core rod towards the cylinder portion overcomes the spring and forces the jaws out of the second end of the cylinder portion and into an open position.

4. The apparatus of claim 1 wherein the attachment comprises one or more hardware components connecting to a neck strap.

5. The apparatus of claim 1 wherein the attachment comprises one or more hardware components connecting to a head band.

6. The apparatus of claim 1 wherein the attachment comprises one or more hardware components connecting to a face shield.

7. The apparatus of claim 1 wherein the attachment comprises one or more hardware components connecting to a vest.

8. The apparatus of claim 1 wherein the attachment comprises one or more hardware components connecting to a button.

9. The apparatus of claim 1 wherein the attachment comprises one or more hardware components connecting to a button hole.

10. The apparatus of claim 1 wherein the attachment comprises one or more hardware components connecting to a safety pin.

11. The apparatus of claim 1 wherein the attachment comprises one or more hardware components connecting to a hat.

12. The apparatus of claim 1 wherein the attachment comprises one or more hardware components connecting to a shirt.

* * * * *